US009724701B2

(12) United States Patent
Harney et al.

(10) Patent No.: US 9,724,701 B2
(45) Date of Patent: Aug. 8, 2017

(54) TAPERED PICK HOLDER

(71) Applicant: Joy MM Delaware, Inc., Wilmington, DE (US)

(72) Inventors: William Harney, Millersburg, KY (US); Jarrod Elliott, Augusta, KY (US)

(73) Assignee: Joy MM Delaware, Inc., Wilmington, DE (US)

( * ) Notice: Subject to any disclaimer, the term of this patent is extended or adjusted under 35 U.S.C. 154(b) by 441 days.

(21) Appl. No.: 14/203,810

(22) Filed: Mar. 11, 2014

(65) Prior Publication Data

US 2014/0263787 A1 Sep. 18, 2014

Related U.S. Application Data

(60) Provisional application No. 61/777,375, filed on Mar. 12, 2013.

(51) Int. Cl.

| | |
|---|---|
| ***B02C 4/10*** | (2006.01) |
| ***B02C 13/28*** | (2006.01) |
| ***E21C 35/18*** | (2006.01) |
| ***B02C 13/06*** | (2006.01) |
| ***B02C 13/286*** | (2006.01) |
| *E21C 35/19* | (2006.01) |

(52) U.S. Cl.

CPC ..... *B02C 13/2804* (2013.01); *B02C 4/10* (2013.01); *B02C 13/06* (2013.01); *B02C 13/286* (2013.01); *E21C 35/18* (2013.01); *E21C 2035/191* (2013.01); *Y10T 29/49826* (2015.01); *Y10T 29/49963* (2015.01)

(58) Field of Classification Search

USPC ..... 241/294

See application file for complete search history.

(56) References Cited

U.S. PATENT DOCUMENTS

| | | | |
|---|---|---|---|
| 147,925 | A | 2/1874 | Firth |
| 1,423,595 | A | 7/1922 | Bayles |
| 1,613,693 | A | 1/1927 | Davis |

(Continued)

FOREIGN PATENT DOCUMENTS

| | | |
|---|---|---|
| CA | 2708907 | 1/2011 |
| CN | 201857970 | 6/2011 |

(Continued)

OTHER PUBLICATIONS

Breaker Pick and Holder, available at least since Mar. 11, 2012 (some information redacted).

(Continued)

*Primary Examiner* — Mark Rosenbaum

(74) *Attorney, Agent, or Firm* — Michael Best & Friedrich LLP

(57) ABSTRACT

A pick system includes a holder and a pick assembly. The holder includes a first end, a second end, and a bore extending between the first end and the second end and defining a longitudinal axis. The surface of the bore may be tapered so that the diameter of the bore proximate the first end is greater than the diameter of the bore proximate the second end. The pick assembly includes a shaft. The shaft is received within the bore of the holder along the longitudinal axis, and the shaft may be tapered to mate with the bore.

19 Claims, 5 Drawing Sheets

(56) References Cited

U.S. PATENT DOCUMENTS

| | | | |
|---|---|---|---|
| 2,700,549 | A | 1/1955 | Cornett |
| 2,893,298 | A | 7/1959 | Averette |
| 3,282,457 | A | 11/1966 | Sirois |
| 3,493,268 | A | 2/1970 | Bower, Jr. |
| 3,519,309 | A | 7/1970 | Engle et al. |
| 3,652,130 | A | 3/1972 | Elders |
| 3,679,265 | A | 7/1972 | Krekeler |
| 3,796,464 | A | 3/1974 | Hansen et al. |
| 4,045,086 | A | 8/1977 | Parkes et al. |
| 4,131,547 | A | 12/1978 | Michel et al. |
| 4,212,559 | A | 7/1980 | Persson |
| 4,275,929 | A | 6/1981 | Krekeler |
| 4,337,980 | A | 7/1982 | Krekeler |
| 4,462,638 | A | 7/1984 | Denbesten |
| 4,571,966 | A | 2/1986 | Lopez, Jr. |
| 4,576,504 | A | 3/1986 | Hartman |
| 4,579,477 | A | 4/1986 | Hartman |
| 4,679,858 | A | 7/1987 | Tank et al. |
| 4,761,900 | A | 8/1988 | Emrich |
| 4,865,080 | A | 9/1989 | Lundquist |
| 5,088,797 | A | 2/1992 | O'Neill |
| 5,261,499 | A | 11/1993 | Grubb |
| 5,318,351 | A | 6/1994 | Walker |
| 5,333,938 | A | 8/1994 | Gale |
| 5,447,208 | A | 9/1995 | Lund et al. |
| 5,810,102 | A | 9/1998 | Stewart |
| 5,944,057 | A | 8/1999 | Pierce |
| D420,013 | S | 2/2000 | Warren et al. |
| 6,585,327 | B2 | 7/2003 | Sollami |
| 6,904,983 | B2 | 6/2005 | Thigpen et al. |
| 6,918,636 | B2 | 7/2005 | Dawood |
| 7,270,379 | B2 | 9/2007 | Stehney |
| 7,380,889 | B2 | 6/2008 | Frear |
| 7,992,945 | B2 | 8/2011 | Hall et al. |
| 8,201,892 | B2 | 6/2012 | Hall et al. |
| 8,342,611 | B2 | 1/2013 | Hall et al. |
| 8,424,974 | B2 | 4/2013 | Latham |
| 2002/0167216 | A1 | 11/2002 | Sollami |
| 2003/0234569 | A1 | 12/2003 | Dawood |
| 2004/0187657 | A1 | 9/2004 | Smith |
| 2007/0079991 | A1 | 4/2007 | Cooley et al. |
| 2008/0008523 | A1 | 1/2008 | Cadet |
| 2010/0071961 | A1 | 3/2010 | Steel et al. |
| 2010/0253130 | A1 | 10/2010 | Sollami |
| 2011/0148178 | A1 | 6/2011 | Lehnert et al. |
| 2013/0008992 | A1 | 1/2013 | Harney et al. |

FOREIGN PATENT DOCUMENTS

| | | | | |
|---|---|---|---|---|
| DE | 29717023 | | 1/1998 | |
| DE | 102011051584 | | 1/2013 | |
| GB | 1587774 | | 4/1981 | |
| GB | 2492646 | A * | 1/2013 | ..... B02C 4/30 |

OTHER PUBLICATIONS

EP14159135.4 Extended European Search Report dated Jun. 20, 2014 (5 pages).

* cited by examiner

TAPERED PICK HOLDER

CROSS-REFERENCE TO RELATED APPLICATIONS

This application claims the benefit of prior-filed U.S. Provisional Application No. 61/777,375, filed Mar. 12, 2013, the entire contents of which are hereby incorporated by reference.

FIELD

The present invention relates to feeder breakers for the mining industry and, in particular, to an arrangement for coupling a pick to a feeder breaker.

SUMMARY

Feeder breakers include a breaker for processing material that is traveling along a conveyor. Typically, the breaker includes an axle, a drum supported by and rotatable with the axle, and holders positioned on an exterior surface of the drum. Each holder supports a pick or an intermediate holder that supports a pick, and the pick engages and breaks apart the material on the conveyor to ensure that the material on the conveyor remains at an acceptable size. A conventional holder includes a straight bore that receives a shank of an intermediate holder. The shank is inserted into the bore from one end and secured at the opposite end by a threaded nut. A spacer ring is positioned in the bore between the holder and the shank. As the breaker engages the material, the impact force of the material against the pick is absorbed by the front face of the holder around the bore from the intermediate holder. Over time, the holder's face may become distorted and cause the intermediate holder to become loose, which may cause the impact forces to shear the shank of the intermediate holder.

In one embodiment, the invention provides a pick system including a holder and a pick assembly. The holder includes a first end, a second end, and a bore extending between the first end and the second end and defining a longitudinal axis. The surface of the bore may be tapered so that the diameter of the bore proximate the first end is greater than the diameter of the bore proximate the second end. The pick assembly includes a shaft. The shaft is received within the bore of the holder along the longitudinal axis, and the shaft may be tapered to mate with the bore.

In another embodiment, the invention provides a feeder breaker for processing cut material. The feeder breaker includes a conveyor and a breaker for engaging the cut material. The conveyor includes a first end for receiving material and a second end for discharging material. The breaker is positioned between the first end and the second end of the conveyor. The breaker includes a drum rotatably supported on an axle and a plurality of pick systems positioned circumferentially around the drum. Each pick system includes a holder and a pick assembly. The holder has a first end and a second end and defines a bore extending between the first end and the second end along a longitudinal axis. A surface of the bore is tapered with a diameter of the bore proximate the first end being greater than a diameter of the bore proximate the second end. The pick assembly includes a shaft received within the bore of the holder along the longitudinal axis. The shaft is tapered to mate with the bore.

In yet another embodiment, the invention provides a method of manufacturing a pick system for a breaker including a drum rotatable about a drum axis and having an outer surface. The method includes forming a pick holder having a first end and a second end, securing the pick holder to the outer surface of the drum, inserting a pick assembly into the first end of the bore, and securing the pick assembly relative to the holder. The pick holder defines a bore extending between the first end and the second end along a longitudinal axis. Forming includes forming a surface of the bore to be tapered with a diameter of the bore proximate the first end being greater than a diameter of the bore proximate the second end. The pick assembly includes a tapered shaft that mates with the bore.

Other independent aspects of the invention will become apparent by consideration of the detailed description and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

Figure 1:
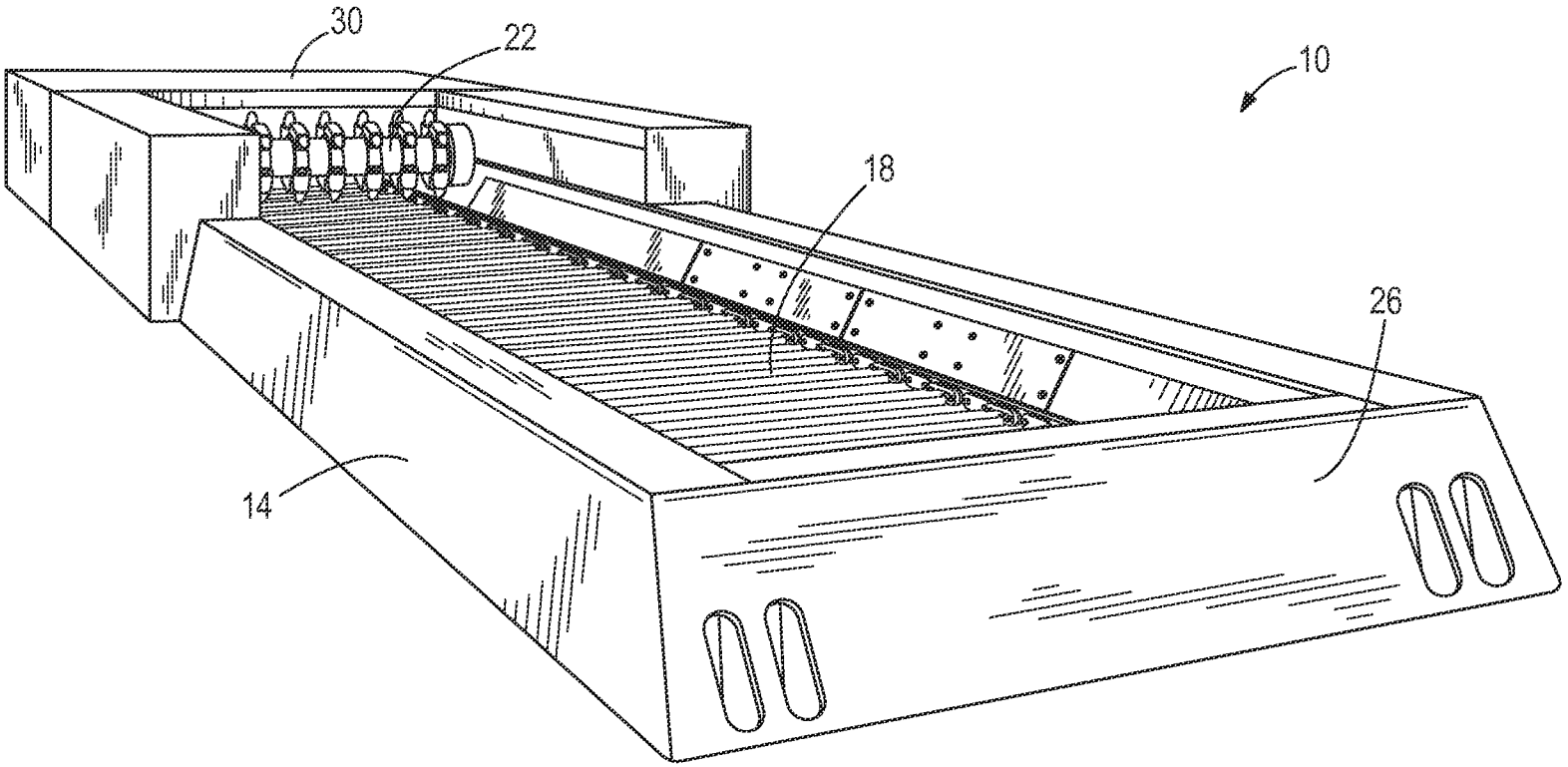
FIG. 1 is a perspective view of a breaker assembly.

FIG. 1 shows a feeder breaker 10 that operates to process material, such as coal, to a desired size and to convey the material. The feeder breaker 10 includes a frame 14, a conveyor 18, and a breaker 22. The conveyor 18 moves material from an intake end 26 to a discharge end 30, and the breaker 22 processes the material therebetween.

Figure 2:
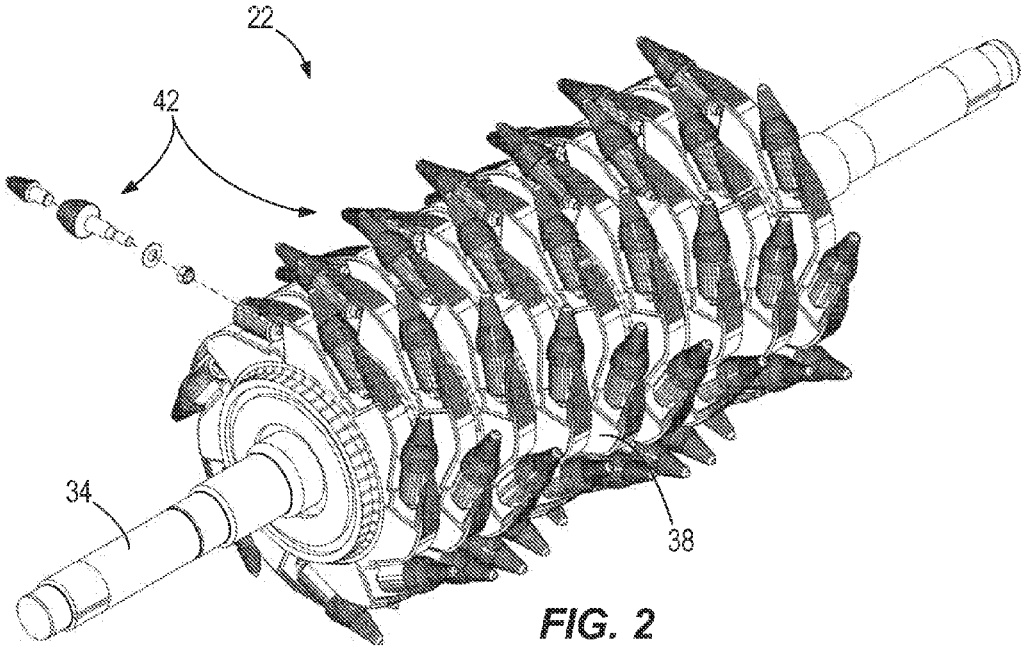
FIG. 2 is a partially exploded perspective view of a breaker.
Figure 3:
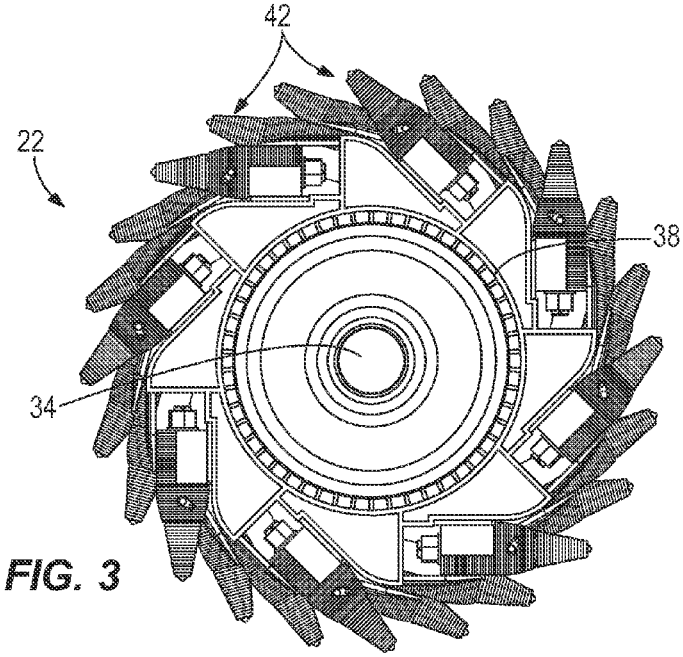
FIG. 3 is a side view of the breaker of FIG. 2.
Figure 4:
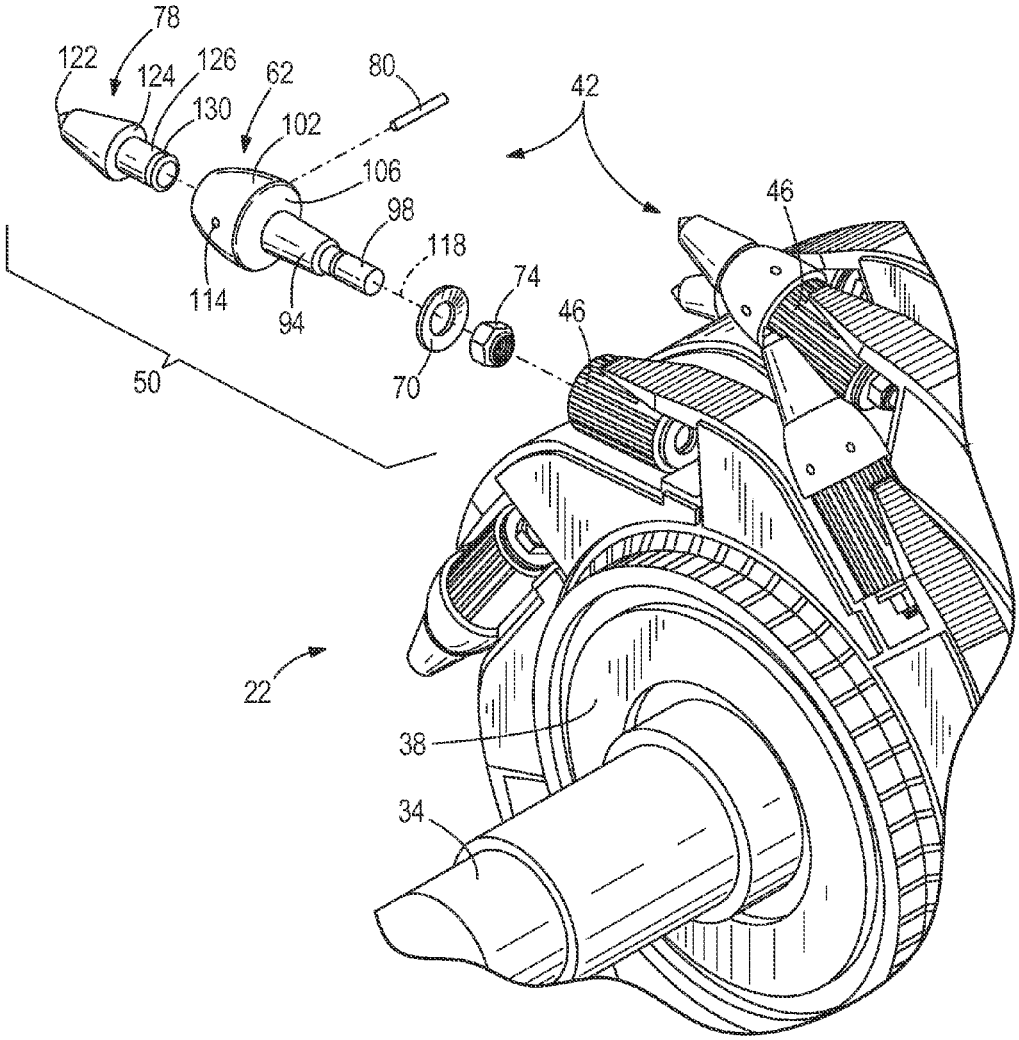
FIG. 4 is an enlarged exploded perspective view of the breaker of FIG. 2.

FIGS. 2-4 illustrate a breaker 22. The breaker 22 includes an axle 34, a drum 38 supported by the axle 34 for rotation therewith, and pick systems 42 extending radially outward from the drum 38. As shown in FIG. 4, each pick system 42 includes a holder 46 and a pick assembly 50 received within the holder 46. In the illustrated embodiment, the holder 46 is welded to the drum 38, and each of the holders 46 includes ribs formed on an exterior surface, which are formed by weld lines. In other embodiments (not shown), the structure of the holder 46 may be different or the holder 46 may be coupled to the breaker 22 in a different way (e.g., fasteners), as desired. The pick assembly 50 is a replaceable part that breaks up material being processed. The pick assembly 50 facilitates simple and easy removal and replacement of the breaker pick 78. As shown in FIG. 4, the pick assembly 50 includes an intermediate holder 62, a washer 70, a nut 74, a locking pin 76 (FIG. 5), a breaker pick 78, and a pin 80. The pick assembly 50 is coupled to the holder 46 along a longitudinal axis 118 and forms a mining point for processing material.

Figure 5:
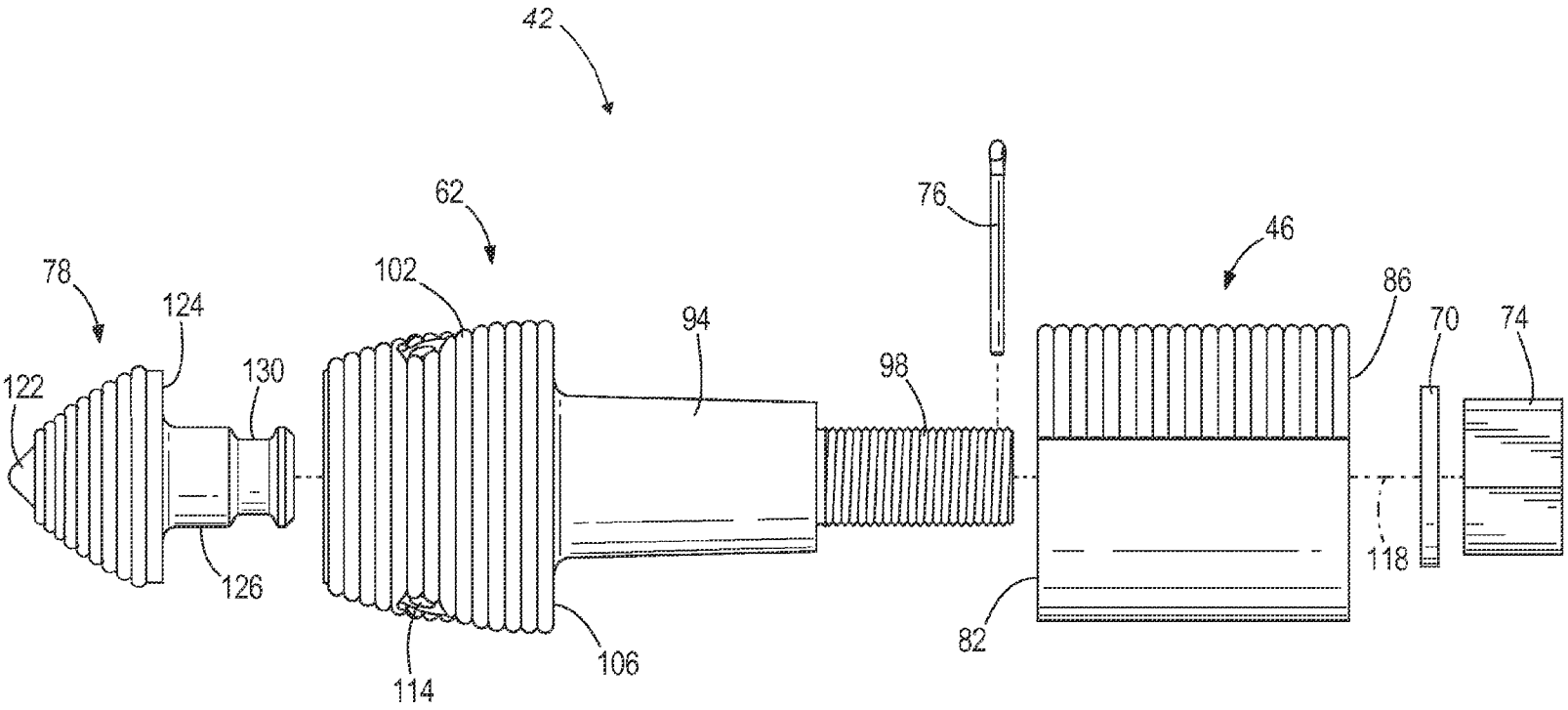
FIG. 5 is an exploded side view of a pick system.
Figure 6:
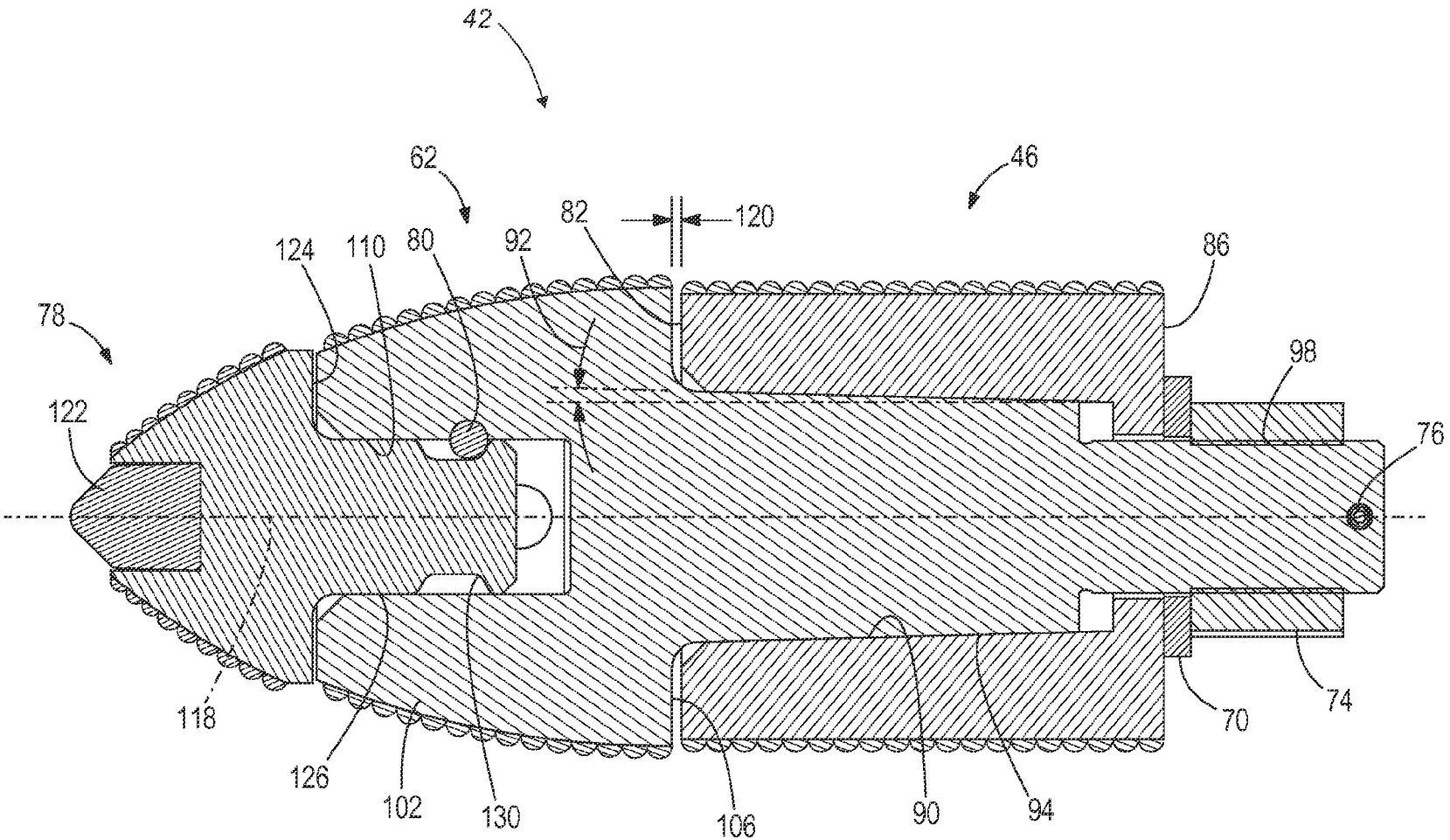
FIG. 6 is a cross-section view of the pick system of FIG. 5.

Referring to FIGS. 5 and 6, the holder 46 has a first end 82 and a second end 86 and defines a bore 90 (FIG. 6)

extending between ends 82, 86. As best shown in FIG. 6, the bore 90 tapers from the first end 82 to the second end 86, so that the diameter of the bore 90 proximate the first end 82 is larger than the diameter of the bore 90 proximate the second end 86. In the illustrated embodiment, the bore 90 forms a continuous, inclined taper substantially between the first end 82 to the second end 86. The tapered bore 90 forms an angle 92 relative to the longitudinal axis 118. In the illustrated embodiment, the angle 92 is approximately 1.493 degrees. In other embodiments, the angle may be between approximately one and two degrees relative to the longitudinal axis 118. In still other embodiments, the angle may be between approximately 0.5 degrees and ten degrees relative to the longitudinal axis 118.

As shown in FIGS. 4-6, the intermediate holder 62 includes a shank or shaft 94, a threaded end portion 98, a body portion 102, and a shoulder 106 between the shaft 94 and the body portion 102. A pick opening 110 (FIG. 6) is formed on an end of the body portion 102 and is configured to receive the breaker pick 78. A pin aperture 114 (FIG. 4) is formed in the body portion 102 and is transverse to and offset from the longitudinal axis 118 of the pick assembly 50. In the illustrated embodiment, the shaft 94 forms a continuous surface without any slots or breaks, and the shaft 94 is tapered in a manner that is substantially identical to the tapered surface of the bore 90. That is, in the illustrated embodiment, the tapered shaft 94 forms an angle relative to the longitudinal axis 118 that is substantially equal to the angle 92. The shaft 94 substantially mates with the bore 90 while forming a space 120 between the first end 82 of the holder 46 and the shoulder 106. In one embodiment, the space 120 is between approximately 0.0625 inches and 0.125 inches (one-sixteenth of an inch to one-eighth of an inch). In other embodiments, the space may be between approximately 0.090 inches and 0.120 inches.

The breaker pick 78 includes a mining point 122, a pick shoulder 124 transitioning to a pick shaft 126, and a pin receiving feature in the form of a groove or a pin recess 130 formed in the shaft 126. The pick shaft 126 is sized to be received within the pick opening 110 of the intermediate holder 62. Further, the pin recess 130 is positioned on the pick shaft 126 such that when the breaker pick 78 is installed in the intermediate holder 62, the pin recess 130 is aligned with the pin aperture 114 (FIG. 4). In other constructions (not shown), the pin receiving feature could be an aperture, a depression, a blind hole, or another feature, as desired.

In the illustrated embodiment, the pin 80 is a coiled spring pin, and both the pin 80 and the pin aperture 114 are sized such that the pin 80 is retained by friction within the pin aperture 114. In the illustrated embodiment, the pin 80 is made from stainless steel. The pin material resists reaction loads and shear failures that result from the impacts that the breaker pick 78 absorbs during normal use. In other embodiments (not shown), other suitable materials may be used or the pin aperture 114 and the pin 80 may be a different shape (e.g., square, rectangular, oval), as desired.

The pick assembly 50 is installed by first inserting the shaft 94 of the intermediate holder 62 into the holder 46 such that the shoulder 106 faces the first end 82 of the holder 46. With the intermediate holder 62 positioned in the holder 46, one or more washers 70 are aligned and installed on the shaft 94 of the intermediate holder 62 proximate the second end 86. The nut 74 is then threaded onto the threaded end portion 98 of the intermediate holder 62. The nut 74 is tightened to a desired torque and/or until the washer(s) 70 are compressed or flattened to a desired thickness. Preferably, this tightness is applied by a torque wrench to prevent over-tightening. The washer 70 acts in cooperation with the nut 74 to inhibit the nut 74 from unthreading (i.e., loosening). The locking pin 76 (FIG. 5) is inserted through at least a portion of the threaded end portion 98 to secure the nut 74 and washer 70 on the threaded end portion 98. In the illustrated embodiment, the locking pin 76 is a cotter pin.

Once the intermediate holder 62 is tightened and secured within the holder 46, the pick shaft 126 of the breaker pick 78 is inserted into the pick opening 110 such that the recess 130 aligns with the pin aperture 114. The pin 80 is inserted into the pin aperture 114 and into the recess 130 of the breaker pick 78 so that the pin 80 is engaged between the body portion 102 of the intermediate holder 62 and the breaker pick 78. Such positive engagement holds the breaker pick 78 securely in position, while the pin 80 remains within the pin aperture 114.

To remove the breaker pick 78, the above installation process is reversed. The pin 80 is pushed out of the pin aperture 114 and therefore out of engagement with the breaker pick 78. Once the used breaker pick 78 is removed, a new breaker pick 78 may be reinserted into the holder 62.

The pick assembly 50 provides a system for replacing breaker picks on feeder breakers with relatively simple tooling. Also, the tapered shaft 94 provides a larger surface area for distributing stress from the impact loads, which may prevent the stress from being concentrated around the first end 82 of the holder 46. In addition, the tapered bore 90 and shaft 94 eliminate the need for a spacer ring, which may reduce the likelihood of shear failure caused by the spacer ring becoming distorted during operation.

Furthermore, in the illustrated embodiment, if the nut 74 were to become loose during operation, the intermediate bit holder 62 would re-seat itself within the bore 90 during the subsequent impact. As a result, the stress would continue to be distributed among the tapered surfaces, which may reduce wear on the intermediate pick holder 62 and extend the life of the pick assembly 50. These and other independent advantages may lead to savings and physical advantages for the end user. When installed, the breaker pick system 50 does not penalize machine performance and may provide an added benefit for the end user.

Thus, the invention may provide, among other things, a tapered pick holder. Although the invention has been described in detail with reference to certain preferred embodiments, variations and modifications exist within the scope and spirit of one or more independent aspects of the invention as described.

The invention claimed is:

1. A pick system comprising:

a holder having a first end and a second end and defining a bore extending between the first end and the second end along a longitudinal axis, a surface of the bore being tapered with a diameter of the bore proximate the first end being greater than a diameter of the bore proximate the second end, the surface of the bore forming an angle between 0.5 degrees and ten degrees relative to the longitudinal axis; and a pick assembly including a shaft received within the bore of the holder along the longitudinal axis, the shaft being tapered to mate with the bore.

2. The pick system of claim 1, wherein the surface of the bore forms an angle between 1 degree and 2 degrees relative to the longitudinal axis.

3. The pick system of claim 2, wherein the surface of the bore forms an angle of approximately 1.493 degrees relative to the longitudinal axis.

4. The pick system of claim 1, wherein the pick assembly includes an intermediate pick holder and a breaker pick, the shaft being formed on the intermediate pick holder, the breaker pick being supported by the intermediate pick holder.

5. The pick system of claim 1, wherein the shaft includes a threaded end portion, the shaft extending from the first end of the holder through the second end of the holder, the shaft being secured relative to the holder by a nut threaded on the threaded end portion.

6. The pick system of claim 5, wherein the pick assembly includes a shoulder proximate the shaft and positioned a distance from the first end of the holder, the distance being between 0.0625 inches and 0.125 inches.

7. The pick system of claim 1, wherein the surface of the bore forms a continuous incline substantially between the first end and the second end.

8. A feeder breaker for processing cut material, the feeder breaker comprising:

a conveyor including a first end for receiving material and a second end for discharging material; and a breaker for engaging the cut material, the breaker being positioned between the first end and the second end of the conveyor, the breaker including a drum rotatably supported on an axle and a plurality of pick systems positioned circumferentially around the drum, at least one pick system including a holder having a first end and a second end and defining a bore extending between the first end and the second end along a longitudinal axis, a surface of the bore being tapered with a diameter of the bore proximate the first end being greater than a diameter of the bore proximate the second end, the surface of the bore forming an angle between 0.5 degrees and ten degrees relative to the longitudinal axis, and a pick assembly including a shaft received within the bore of the holder along the longitudinal axis, the shaft being tapered to mate with the bore.

9. The feeder breaker of claim 8, wherein the surface of the bore forms an angle between 1 degree and 2 degrees relative to the longitudinal axis.

10. The feeder breaker of claim 9, wherein the surface of the bore forms an angle of approximately 1.493 degrees relative to the longitudinal axis.

11. The feeder breaker of claim 8, wherein the pick assembly includes an intermediate pick holder and a breaker pick, the shaft being formed on the intermediate pick holder, the breaker pick being supported by the intermediate pick holder.

12. The feeder breaker of claim 8, wherein the shaft includes a threaded end portion, the shaft extending from the first end of the holder through the second end of the holder, the shaft being secured relative to the holder by a nut threaded on the threaded end portion.

13. The feeder breaker of claim 12, wherein the pick assembly includes a shoulder proximate the shaft and positioned a distance from the first end of the holder, the distance being between 0.0625 inches and 0.125 inches.

14. A method of manufacturing a pick system for a breaker, the breaker including a drum rotatable about a drum axis and having an outer surface, the method comprising:

forming a pick holder having a first end and a second end and defining a bore extending between the first end and the second end along a longitudinal axis, forming the pick holder including forming a surface of the bore to be tapered with a diameter of the bore proximate the first end being greater than a diameter of the bore proximate the second end, the bore having an angle between 0.5 degrees and ten degrees relative to the longitudinal axis;

securing the pick holder to the outer surface of the drum;

inserting a pick assembly into the first end of the bore, the pick assembly including a tapered shaft that mates with the bore; and securing the pick assembly relative to the holder.

15. The method of claim 14, forming a pick holder includes forming a bore having an angle between 1 degree and 2 degrees relative to the longitudinal axis.

16. The method of claim 15, forming a pick holder includes forming a bore having an angle of approximately 1.493 degrees relative to the longitudinal axis.

17. The method of claim 14, wherein inserting a pick assembly includes inserting a shaft of an intermediate pick holder into the bore, inserting a breaker pick into an opening of an intermediate pick holder, and securing the breaker pick relative to the intermediate pick holder.

18. The method of claim 14, wherein securing the pick assembly includes threading a nut onto a threaded end portion of the shaft of the pick assembly, the shaft extending from the first end of the holder through the second end of the holder.

19. The method of claim 18, wherein inserting the pick assembly includes positioning a shoulder of the pick assembly proximate the first end of the holder and spaced a distance from the first end of the holder, the distance being between 0.0625 inches and 0.125 inches.

* * * * *